US006065753A

United States Patent [19]

Morosky

[11] Patent Number: 6,065,753

[45] Date of Patent: May 23, 2000

[54] METHOD OF ADMINISTERING AND PLAYING A BACCARAT TYPE CARD GAME

[75] Inventor: Jon P. Morosky, Danielson, Conn.

[73] Assignee: New Wave Gaming Products, Inc., Danielson, Conn.

[21] Appl. No.: 08/957,960

[22] Filed: Oct. 21, 1997

[51] Int. Cl.[7] ..... A63F 1/00

[52] U.S. Cl. ..... 273/292; 463/12

[58] Field of Search ..... 273/292, 274, 273/309; 463/12

[56] References Cited

U.S. PATENT DOCUMENTS

| | | | |
|---|---|---|---|
| 5,257,810 | 11/1993 | Schorr et al. | 273/292 |
| 5,382,025 | 1/1995 | Sklansky et al. | 273/292 |
| 5,395,119 | 3/1995 | Jacob et al. | 273/274 |
| 5,486,005 | 1/1996 | Neal | 273/292 |
| 5,573,249 | 11/1996 | Johnson | 273/292 |
| 5,839,731 | 11/1998 | Feola | 273/292 |

OTHER PUBLICATIONS

"Baccarat", Scarne's Encyclopedia Of Games, John Scarne, Harper & Row Publishers, pp. 290–296, 1973.

*Primary Examiner*—Benjamin H. Layno
*Attorney, Agent, or Firm*—Theodore Stevenson, III

[57] ABSTRACT

A method of administering and playing a baccarat type card game is disclosed in which three hands are dealt face-up, having three cards each. Players wager on which hand will win, and can also wager on ties between two or more hands. After the first card is dealt to each hand, players are given the opportunity to alter their wagers, either by surrendering a portion of their wager and withdrawing from the hand, or by increasing the wager up to the amount of the original wager. Then, a second card is dealt face-up, and the players are again given the opportunity to surrender a portion of their wagers and withdraw from the hand. When the hands are complete, the point total for each hand is calculated and the winning or tied hands are paid.

14 Claims, 3 Drawing Sheets

METHOD OF ADMINISTERING AND PLAYING A BACCARAT TYPE CARD GAME

BACKGROUND OF THE INVENTION

1. Field of the Invention

This invention relates to a casino card game that allows players to wager on their choice of a number of different hands to be dealt, that has easy to understand rules, and that permits player to alter their bets as cards are dealt to the hands.

2. Description of the Related Art

In casinos, there are a number of card games that enjoy some popularity, but each of which has its own drawbacks. For instance, Blackjack is probably the most popular casino card game, but players are confined in that they can only wager on their own hand and cannot choose to wager on the house's hand. Further, in Blackjack if there is a tie between the house and the player, the hand is a push; there is no option for a player to wager on a tie. Nor does Blackjack offer high odds; the highest odds offered are 1½ to 1 for a natural 21.

Baccarat is another popular casino card game. However, the rules for drawing cards in Baccarat are confusing, and account for many players avoiding this game. Further, Baccarat does not allow a player to increase or decrease his original wager after a portion of the hand has been dealt. Another disadvantage is that players who wager on the house hand in Baccarat must pay a 5% vigorish to the house, which many players find unpleasant.

Poker also enjoys some popularity in casinos, but one drawback of poker is that it is not a very fast paced game. Another disadvantage is that, in poker, players handle their cards, which introduces the opportunity for cheating by marking, bending, or switching cards. A further disadvantage is that, in poker, the players compete against each other, and therefore the aspect of camaraderie is destroyed. Finally, in poker the number of players who can participate in one game is limited to as few as seven (for seven-card stud format games) or six (for five card draw with a three card draw wherein discards are not recycled).

The present invention provides solutions to these problems.

SUMMARY OF THE INVENTION

It is a primary object of this invention to provide a game that allows players to choose among a number of different hands to wager on.

It is another object of this invention to provide a game that allows players to wager on ties, and thereby to receive higher odds.

Still another object of this invention to provide a game with easy-to-understand rules.

Another primary object of this invention is to provide a game that allows players to alter the amount of their wagers as cards are dealt to each hand.

Yet another primary object of this invention is to provide a game that does not require the house to charge a vigorish to provide it with an acceptable advantage.

An additional object of this invention is that players do not handle the cards, as each hand is dealt face-up by a dealer, which reduces the possibilities for cheating by marking the cards.

A further object of this invention is that there is no limit on the number of players who can participate at once.

It is an advantage of this game that it provides the house with an acceptable advantage without having to charge a vigorish or resort to complex rules.

It is another advantage of this game that it creates an air of camaraderie as people who have wagered on the same hand can root together that their hand will win.

The rules of this card game are novel, and depart significantly from any other card games that have ever been played in casinos. The rules are specially designed to create an exciting atmosphere that allows players the flexibility of increasing or surrendering their wagers after part of the hand has been dealt. Players seeking higher odds can bet on a tie among two or more hands.

In the preferred embodiment of this game, a casino administers this game among one or more players who are physically present in the casino. Three hands are dealt face up, one card at a time. Each hand is given a name corresponding to a symbol. The symbols chosen have no particular significance other than as a colorful way to refer to the hands. In the preferred embodiment, each hand has a representative character chosen from the Chinese zodiac for its symbolism. The Tiger is symbolic of strength and courage. The Snake is attributed great wisdom. The Dragon is known for its dynamism and power. All three characters also share one common trait that sets them apart from all others in the zodiac—their good luck. It will be understood by those skilled in the art that the symbols used can be changed without departing from the spirit of the invention, but can aid in the marketing aspects of the game to create mystique or to attract interest.

Rather than competing against other players or the house, before each hand is dealt each player chooses a hand (or character) to wager on. The player is not limited as to which hand he may wager on, and the player may wager on any hand that suits his fancy regardless of which hand he has wagered on in previous hands. It is possible for more than one player at the table to wager on the same hand. For instance, if there are eight players, it is possible that five might wager on the Dragon hand, three might wager on the Tiger hand, and none wager on the Snake hand.

The dealer deals three cards to each hand in order, face up. After the first card is dealt to each hand the players are afforded an opportunity to adjust their bets. After the second card is dealt, the players are afforded another opportunity to adjust their bets. Once the third card is dealt, the casino identifies the winning hand and resolves the wagers. The hand with the highest point total is the winning hand, and all players who wagered on that hand are paid.

In the preferred embodiment, actual cards are dealt to the players who are physically present and sitting at the table in the casino. The game could also be played using computers to handle some or all of the steps of the invention. Computerized card games are becoming more popular in casinos, as patrons are overcoming any initial suspicion of computerized gambling devices. Another advantage of using computers in casinos is that they allow the player to wager using an account that is set up with the casino. The players can be given a version of a debit card that accesses that account; this eliminates the need and risk of players maintaining a supply of chips or coins.

In one alternative embodiment, the casino has one or more central areas, such as a table, in which the hands are dealt (either by a human using real cards or by a computer program using graphic depictions of real cards). The players place and alter their wagers on a computer terminal attached to a host computer that administers the game and maintains an account for keeping track of each player's winnings or losings. This obviates the potential for any human errors in making payoffs or determining point totals of hands.

In another embodiment of the invention, each player has a computer monitor and all the hands dealt would be shown on the computer monitor. The players place wagers or take other actions by entering the action using any number of standard computer input devices (i.e., keypads, mice, trackballs, touch-screens, etc). In essence, the game is played by one player on a computer terminal.

In another alternative computerized embodiment of the game, the players participate over a network. Given the advent of the internet and, in general, networking computers, players log onto a network (via the internet, direct dial up connection, direct data connection, or any other means of connecting to a network). Once connected, a host computer runs the game according to the method set forth herein, and the player participates by placing and adjusting wagers, and then seeing the results over the computer network. Winnings or losings are credited or debited to an account the player has with the casino.

The foregoing has outlined some of the more pertinent objects and features of the present invention. These objects should be construed to be merely illustrative of some of the more prominent features and applications of the invention. Many other beneficial results can be attained by applying the disclosed invention in a different manner or modifying the invention as will be described. Accordingly, other objects and a fuller understanding of the invention may be had by referring to the following Detailed Description of the Preferred Embodiment.

BRIEF DESCRIPTION OF THE DRAWINGS

For a more complete understanding of the invention, reference should be made to the following drawings in conjunction with the Description of the preferred embodiment.

DETAILED DESCRIPTION OF THE PREFERRED EMBODIMENT

In the preferred embodiment of the game, a standard 52-card deck is used. Although the game can be played with one deck of cards, it can also be played with multiple decks of cards shuffled together. Because the cards are assigned point values according to the actual card, it would be possible and within the invention to modify one or more 52-card decks to change the cards, as long as the relative number of cards corresponding to each point value remained the same. For example, in a standard 52-card deck there are four tens and twelve face cards; in the game these cards are all assigned a value of zero. It would be within the spirit of the invention to replace these cards with some other non-standard or non-traditional group of cards that had, perhaps, a different name or pictorial if they were assigned the value of zero.

Figure 2:
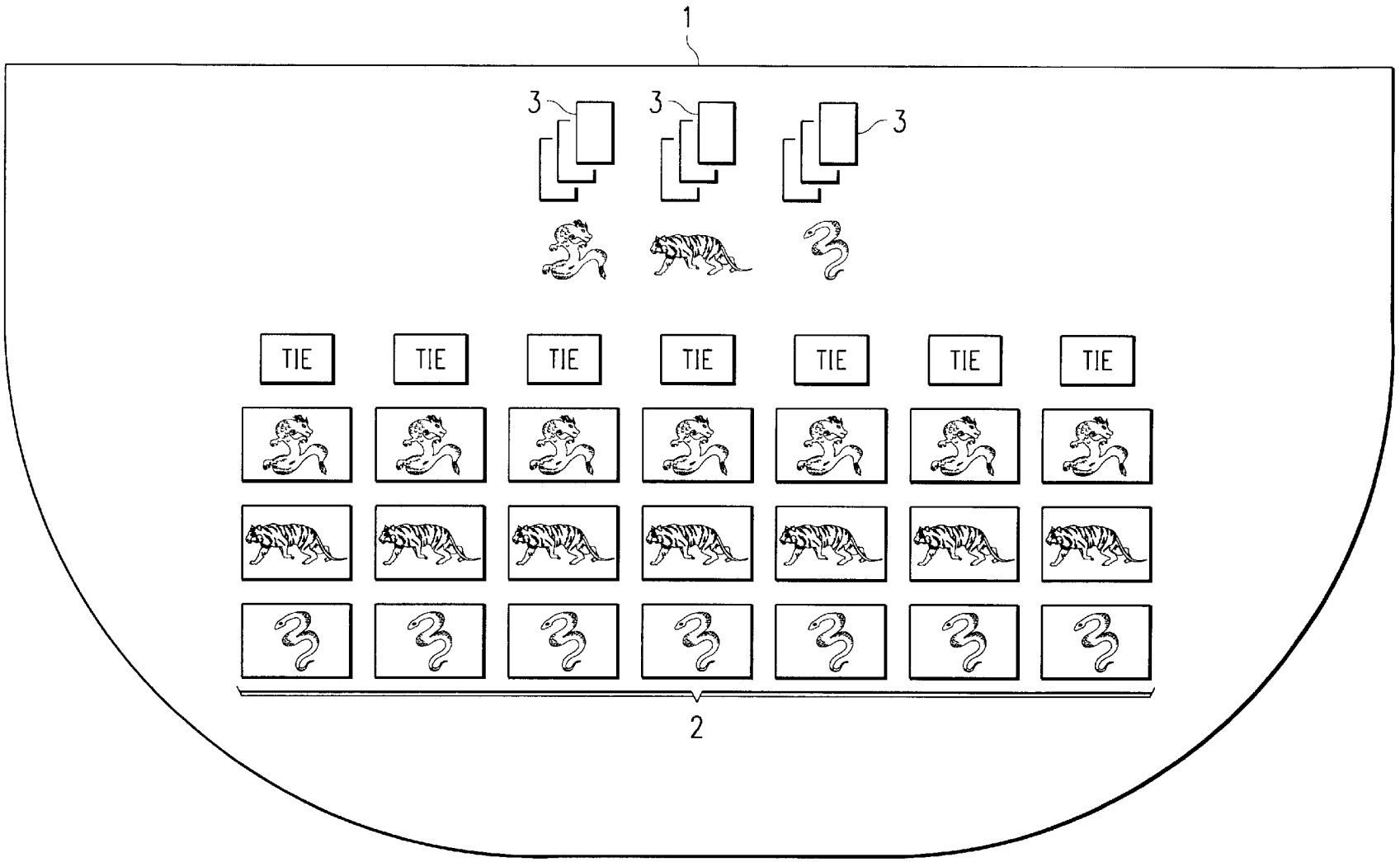
FIG. 2 is the playing surface layout for the preferred embodiment, which can be implemented on a physical table or on a computer screen.

Players sit at a playing surface, which in the preferred embodiment is a table. The playing surface (1) is shown in FIG. 2. The dealer stands or sits on the other side of the playing surface, and deals the cards onto the playing surface.

The playing surface contains a plurality of wagering areas (at least one for each active player) in which the player can place their wagers (2). Each wagering area is divided corresponding to the wagering options available to the player. The wagering area contains portions corresponding to the three hands to be dealt: Tiger, Snake, and Dragon. Each wagering area also provides a portion for wagering on a tie. The players place their wagers in the portion of the wagering area that corresponds to the wager that the player wishes to place. For instance, a wager placed in the Tiger area would be a wager on the Tiger hand to win.

The playing surface also contains a dealing area for the cards to be dealt. The dealing area is divided into portions for three different hands (3). Each hand is dealt into the portion of the dealing area that corresponds to that hand.

Figure 1A:
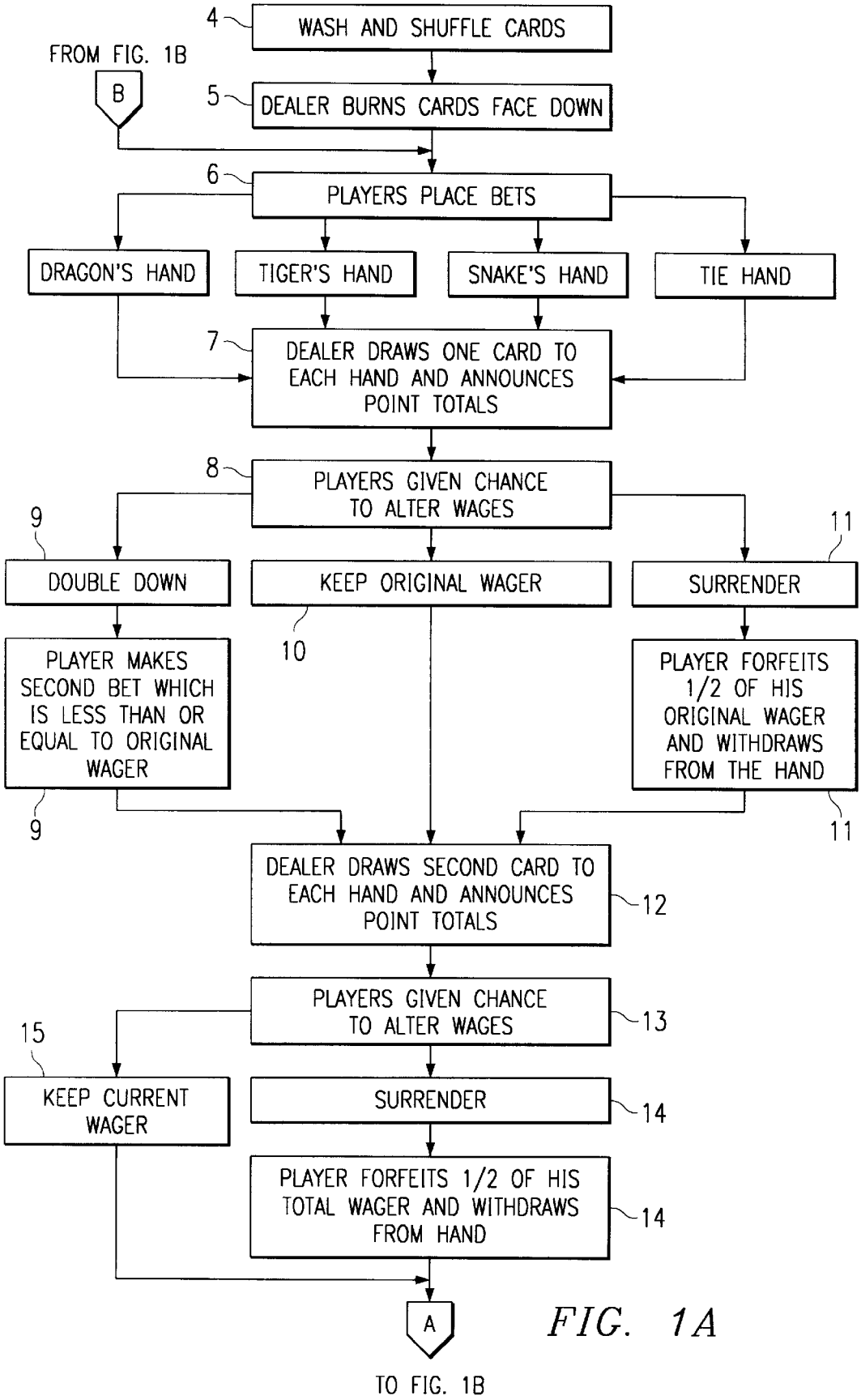
FIG. 1 shows a flowchart of the preferred embodiment.
Figure 1B:
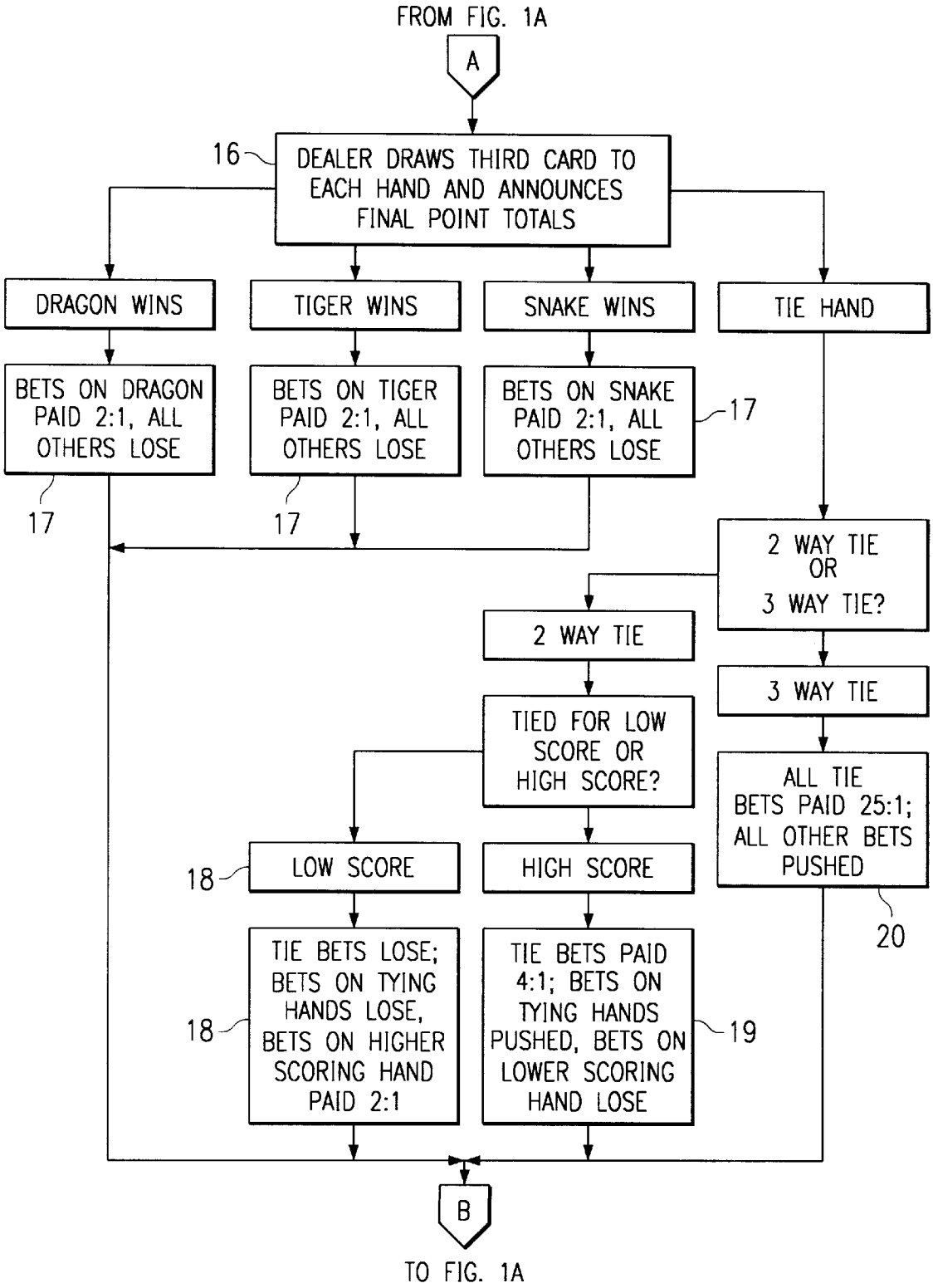

The game play is described in the flowchart attached as FIG. 1. First, the cards are washed and shuffled (4). Then, the dealer "burns " one or more cards by removing them from the deck and placing them, face down, to the side out of play. (5).

Before the first card is dealt for each hand the players wager on which hand they believe will ultimately have the highest total score (6). Players make their wagers by placing chips or money in the portion of the playing surface that corresponds to the hand they wish to wager on.

The score of a hand is preferably calculated by adding the point values of the cards in that hand, with the suit being irrelevant. An ace has a point value of one, tens and face cards have a value of zero, and all other cards have a point value equal to the numeric value of the card (i.e., the four of hearts has a point value of four). If the cards in a hand have a collective point value equal to or exceeding ten, then the tens digit is not considered (i.e., discarded) and the point value of the hand is equal to the ones digit in the hand. Thus, the highest score that a hand can have is nine. For example, if a hand is dealt one card which is an Eight (8), the point value of that hand is eight. If the next card dealt to the hand is a Two (2), the score of the hand becomes zero, because eight plus two equals ten, and therefore the ten's digit is ignored and the ones'digit (in this case, zero) becomes the score of the hand. If the next card dealt to the hand is a Seven (7), the score of the hand becomes seven, because the collective point value of the cards in the hand is seventeen, which is equal to or more than ten, so the ones'digit becomes the score of the hand.

In the preferred embodiment, three different hands are dealt three cards each. Each hand is dealt into the portion of the dealing area that corresponds to that particular hand. After the players place their wagers on a character and/or on a tie, the first card is dealt face up to each hand and the dealer announces the point totals as shown in FIG. 1 (7). Each player is now given a first opportunity to alter his wager (8) as follows: he can "double down" or increase his wager in an amount up to the original wagered amount (9), he can keep his original wager unchanged (10), or he can surrender (11). If the player surrenders, he returns one half or some other predetermined portion of his wager to the house and withdraws from the hand.

Once all players have been given the opportunity to alter their wagers each hand is dealt a second card and the dealer announces the point totals (12). Each player is then given a second opportunity to alter his wager (13): he can either surrender (14) by forfeiting one half or some other predetermined portion of the wager and withdrawing from the hand, or he can keep his original wager unchanged and play out the hand (15).

At either one or both of the opportunities for players to alter their wagers, one may allow the players to choose between all three options or restrict them to a combination of any two options. Additionally, after the second card has been dealt casino management may also opt to not allow any wager changes at all. The casino management is provided this latitude so that they may adjust the house advantage to their specifications.

After all the players have had the opportunity to alter their wagers for the second time the third and final card is dealt for each hand. At this point, the final point totals are determined for each hand and the winner or ties are declared (16).

After the final card is dealt, the wagers are resolved according to predetermined odds. Losing wagers are collected by the house. In the preferred embodiment, wagers on the winning character are paid 2 to 1 (17). Tie bets are paid as follows: 2 way tie for low score: loss (18); 2 way tie for high score, paid 4to 1 (19); 3 way tie, paid 25 to 1 (20). At the option of the casino, the amount of the winning wager payout can be increased or decreased. This will have an affect on the amount of the house percentage advantage. Higher payouts would decrease the house percentage, while lower payouts would increase the house percentage. Such modifications should be considered within the scope of the invention.

Another possible variation would be to change the number of hands to be dealt. Although three hands offers the preferred level of complexity, it would be possible to have a simpler game with two hands or a more complex game with four or more hands.

Other possible variations involve the payoffs in instances that involve a tie between any two or all three of the hands. Casino management may again, at its discretion, decide to alter the procedures to tailor the house advantage. In instances of a two way tie for low score, management may decide to push rather than collect tie wagers. Management may also decide to push rather than collect wagers on the tying characters. In instances of a two way tie for high score management may decide to increase the 4:1 payoff on tie wagers. It may also opt to pay rather than push wagers on the two tying characters and/or push rather than collect wagers on the lower scoring third hand. In instances of a three way tie management may opt to alter the 25:1 payoff on tie wagers. It may decrease the payoff to a 15:1 or increase the payoff to whatever it wishes. Such modifications should be considered within the scope of the invention.

I claim:

1. A method of administering a card game using at least one deck of cards, comprising the following steps:

a) allowing players to place their original wagers corresponding to a particular one or more of a plurality of hands to be dealt;

b) initially dealing only a first card for each hand;

c) after step b), allowing the players a first opportunity to alter their wagers;

d) after step c), dealing a second card for each hand;

e) after step d), allowing the players a second opportunity to alter their wagers;

f) after step e), dealing a third card for each hand;

determining the point total of each hand to determine whether it is a mandatory winner, loser, or a tie under a point system where the value of the hand equals the ones digit of the point total for that hand;

declaring the hand with the highest point total the winner, or if two or three hands tie for the highest point total, declaring a tie for the highest point total; and, resolving the wagers.

2. The method of claim 1, comprising the additional step of providing a playing surface for the players, said playing surface having an area for players to place their wagers, such area divided corresponding to the wagering options available to the player.

3. The method of claim 2, wherein the playing surface also has a dealing area for the cards to be dealt, said dealing area being divided into a plurality of different hands.

4. The method of claim 2, wherein the playing surface is a table.

5. The method of claim 2, wherein the playing surface is represented on a computer monitor.

6. The method of claim 3, wherein the playing surface has a wagering area divided into portions corresponding to wagers on the hands to be dealt and to wagers on ties.

7. The method of claim 1, wherein during the step of allowing the players a first opportunity to alter their wagers, the players are limited to altering their wagers in accordance with one of the following options: keeping their original wager unchanged, increasing their original wager, or surrendering a portion of their original wager to withdraw from the game.

8. The method of claim 7, wherein the amount by which the players may increase their original wager during the first opportunity to alter the wagers is equal to the amount of the original wager.

9. The method of claim 7, wherein the player must surrender one-half of his original wager during the first opportunity to alter the wagers to withdraw from the game.

10. The method of claim 1, wherein during the step of resolving the wagers, if there is one winning hand with the highest point total, it is paid at two-to-one odds.

11. The method of claim 1, wherein during the step of players placing their original wagers, the players are allowed to place a wager that two or more hands will tie for highest point total, and during the step of resolving the wagers, if two or more hands tie for highest point total, paying any tie wagers.

12. A method of playing a card game using at least one deck of cards, comprising the following steps:

a) having each player place an original wager corresponding to a particular one or more of a plurality of hands to be dealt;

b) initially dealing only a first card for each hand;

c) after step b), allowing each player a first opportunity to alter his wager;

d) after step c), dealing a second card for each hand;

e) after step d), allowing each player a second opportunity to alter his wager;

f) after step e), dealing a mandatory third card for each hand;

determining the point total of each hand to determine whether it is a winner, loser, or a tie under a point system where the value of the hand equals the ones digit of the point total for that hand;

declaring the hand with the highest point total the winner, or if two or three hands tie for the highest point total, declaring a tie for the highest point total; and, resolving the wagers.

13. The method of claim 12, wherein during the step of allowing the players a first opportunity to alter their wagers, the players are limited to altering their wagers in accordance with one of the following options: keeping their original wager unchanged, increasing their original wager, or surrendering a portion of their original wager to withdraw from the game.

14. The method of claim 13, wherein during the step of players placing their original wagers, the players are allowed to place a wager that two or more hands will tie for highest point total, and during the step of resolving the wagers, if two or more hands tie for highest point total, paying any tie wagers.

* * * * *